US005460414A

United States Patent [19]

Sargis

[11] Patent Number: 5,460,414

[45] Date of Patent: Oct. 24, 1995

[54] ILLUMINATED BOOK

[76] Inventor: Richard A. Sargis, 8167 Shoreen St., Hilmar, Calif. 95324

[21] Appl. No.: 342,213

[22] Filed: Nov. 18, 1994

[51] Int. Cl.[6] ..... B42D 1/00

[52] U.S. Cl. ..... 281/38; 281/51; 402/79; 402/80 R

[58] Field of Search ..... 281/36, 37, 51, 281/38; 402/80 R, 79

[56] References Cited

U.S. PATENT DOCUMENTS 2,685,638 8/1954 Littrell ..... 281/51 X
5,118,138 6/1992 Brotz ..... 402/80 R
5,203,702 4/1993 Wilson ..... 281/51 X

*Primary Examiner*—Willmon Fridie
*Attorney, Agent, or Firm*—William Nitkin

[57] ABSTRACT

A book having at least one page with a base sheet and a cover sheet disposed thereon with illustrations on the cover sheet with at least one aperture formed in the cover sheet corresponding to a pictorial element in the illustration and at least one fiber optic strand extending between the base sheet and the cover sheet with one end of the fiber optic strand disposed under the aperture and the other end disposed at a light source, causing light to be transmitted through the fiber optic strand such that it is visibly illuminated within the aperture to form part of the pictorial content of the illustration.

3 Claims, 2 Drawing Sheets

ILLUMINATED BOOK

BACKGROUND OF THE INVENTION

1. Field of the Invention

The structure of this invention resides in the area of self-contained, illumination of printed material and more particularly relates to the illumination of portions of pages of a story book to better illustrate and enliven the meaning and spirit of the story.

2. Description of the Prior Art

Children's story books which contain forms of non-traditional illumination are known in the prior art. For example, it is known to coat portions of illustrations of children's books with material that when exposed to direct light will glow in the dark for a brief period of time.

SUMMARY OF THE INVENTION

It is an object of this invention to provide a book having pages with illustrations thereon with sections thereof which can be illuminated by fiber optic strands to better illustrate the story and make its illustrations more appealing to the reader. Such illumination means can be incorporated, for example, in holiday books such as Christmas stories where the illuminated segments can represent strings of Christmas lights on houses or in educational books to illustrate, for example, individual stars in constellations.

It is a further object to have the book of this invention have folding-out, free-standing pages which can be used as a decorative holiday display piece.

It is a still further object to have the illumination system of this invention incorporated within a game board within the book or as a separate unit as well as in greeting cards.

In order to produce fiber optic illumination, a portion of the book cover can have a single or multiple power supply such as batteries to provide electricity to a light source which directs light to the ends of a fiber optic bundle made up of a plurality of fiber optic strands. The fiber optic strands are directed through the spine of the book between each base sheet and cover sheet where the tip of each fiber optic strand is cut at an angle to form a parallel plane to the plane of the cover sheet of the sandwiched page of the book. The strands are glued in place between the base sheet and the cover sheet with the angularly cut second ends of the fiber optic strands placed under and showing through small apertures cut in the cover sheet as well as on each illustrated page where they are used throughout the book or section of the book. An on/off switch or set of electrical contacts on the sides of any section of the spine can activate the light, causing the fiber optic bundle to transmit light to illuminate the second ends of the fiber optic strands through the apertures in the cover sheet of each page of the book of this invention. The cover sheet has an illustration thereon and the illuminated areas represent objects that would be giving off light in the story.

DESCRIPTION OF THE PREFERRED EMBODIMENT(S)

Figure 2:
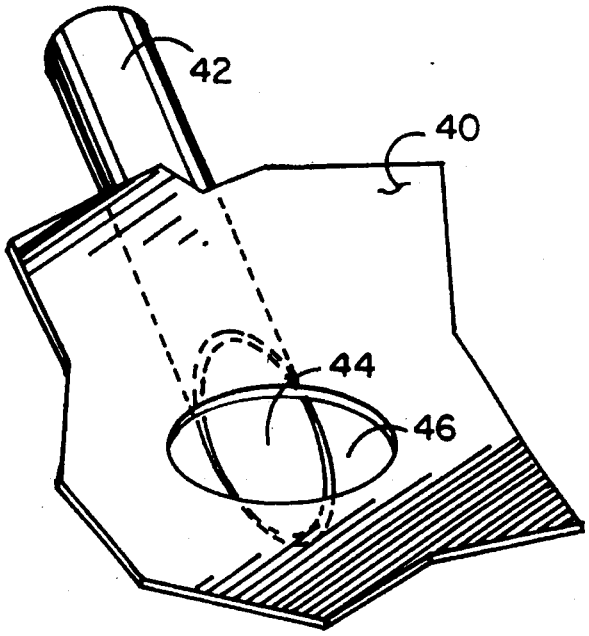
FIG. 2 illustrates a portion of a page of the book showing an aperture in the cover sheet with fiber optic strand attached thereunder.

The illuminated book 10 of this invention can have a plurality of pages, each made of a base sheet 32 and a cover sheet 34 which are sandwiched together by glue or equivalent means. Positioned between base sheet 32 and cover sheet 34 can be a plurality of fiber optic strands 21. A bundle 22 of fiber optic strands in the spine of the book extends down to a common face disposed immediately above a light bulb 18 which receives power through an electrical line 16 from a plurality of batteries 14 within battery pack 12 which can be attached to the cover of the book. When the light is turned on via a set of electrical contacts on the sides of any section of the spine or by manually turning on on/off switch 13, light bulb 18 provides light to the second ends of each of the fiber optic strands, such as strands 26, 28 and 30, within the bundle; and the illuminated second ends can be seen through apertures 46 in cover sheet 40 as seen in FIG. 2. A color wheel can be used between light bulb 18 and the first ends of the fiber optic bundle 22 to provide various colors as it moves by chance under the base of the fiber optic bundle. If desired, a plurality of color areas can be formed on color wheel 20 which by shifting during normal handling the various colors are moved under the first ends of the fiber optic strands and impart that color to the light passing through those strands. This feature causes a change of colors to appear within the apertures 46 of the cover sheet of each book page.

Figure 1:
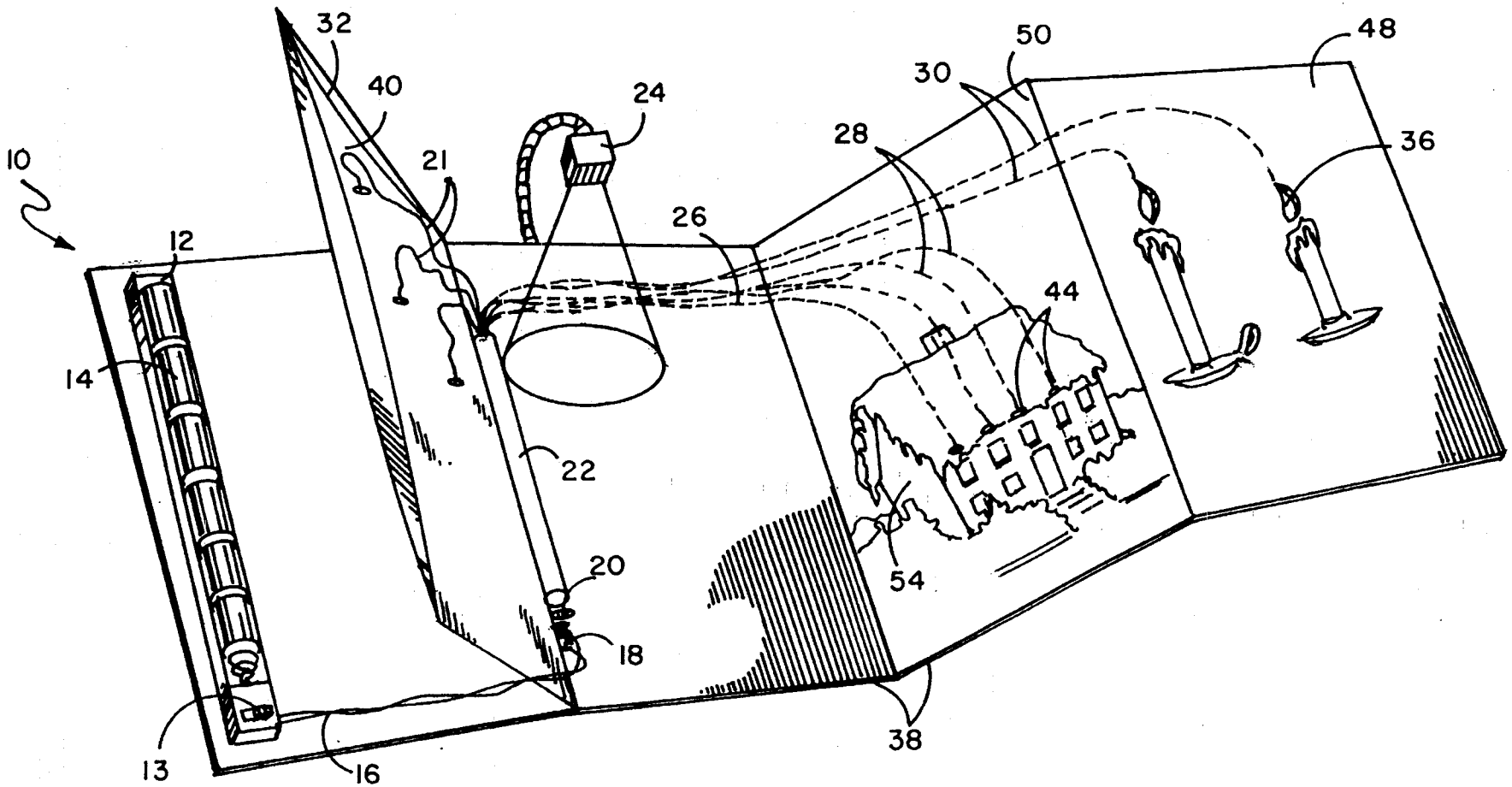
FIG. 1 illustrates a perspective view of the illuminated book of this invention having a plurality of pages and a back cover which folds out.
Figure 3:
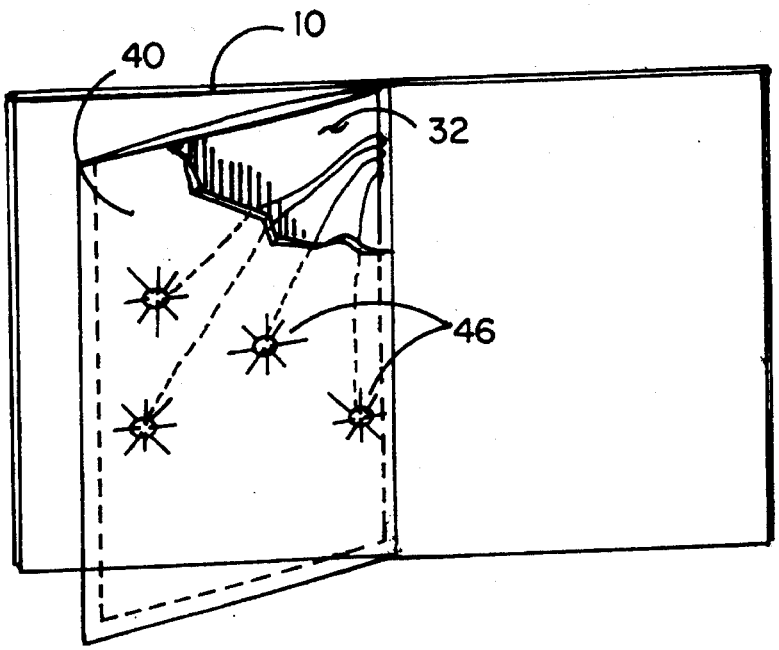
FIG. 3 illustrates the component parts of a page to be used in the book of this invention showing the base sheet separated from the cover sheet with apertures defined in the cover sheet.

FIG. 1 also illustrates the rear cover of the book of this invention which can fold out to be used as an illuminated display piece. A plurality of fold-out pages can be incorporated into the book of this invention and four pages are shown herein as a preferred embodiment. The rear cover illustrates, as an example, the picture of a home 54 having Christmas lights 44 thereon. Each Christmas light is formed of an aperture 46, as seen in FIG. 2, formed in cover sheet 40. Behind each aperture 46 is a fiber optic strand 42, the second end 44 of which is cut at an angle to form angular plane surface to be generally parallel to the plane of each cover sheet such that any light emanating from light bulb 18 will then be transmitted along the fiber optic strand and be visible over the entire angular cut surface 44, appearing to illuminate that spot in the illustration that might represent one of a series of Christmas lights as seen in FIG. 1 on house 54. On panel 48 of the display piece aperture 36 can be used to illuminate the flame of a candle. Any picture where it would be desirable to illuminate an area such as, for example, a picture with a stop light or a picture of the sky where the various stars would be illuminated in the sky can utilize the structure of this invention where the fiber optic strands such as strands 26, 28 and 30 extend between the base sheet and cover sheet 50 to be glued and positioned under an aperture 46 so that they will then have their angular cut ends 44 illuminated. A typical page of the book of this invention is illustrated in FIG. 3. Seen are base sheet 32 and cover sheet 40 with plurality of apertures 46 disposed therein. In FIG. 1 the fiber optic strands, such as strands 26, 28 and 30 pass and are attached and glued between base sheet 32 and cover sheet 40 with their second ends 44 disposed behind apertures to illuminate the relevant portions of the illustration on the cover sheet.

In some embodiments an additional light, utilizing the same power source, can be attached to the back of the book. This light, such as light 24, when desired to be used, can be pulled up from the rear of the book and extended over the pages to form a light by which the book can be read.

When one desires to illuminate the pages of the book of this invention or the fold-out display, one can turn on the power source, such as battery pack 12 by manual means which technology is well known. In one embodiment of this invention, if it is desired to illuminate the fold-out pages of the book as a display for an extended period of time, house current can be utilized as a power source through a voltage converting transformed not illustrated herein.

The structure of having a face sheet with apertures therein on a base sheet with fiber optic strands therebetween extending to the various apertures to be illuminated can also be incorporated into a game board as part of the book or a separate unit as well as in greeting cards.

Although the present invention has been described with reference to particular embodiments, it will be apparent to those skilled in the art that variations and modifications can be substituted therefor without departing from the principles and spirit of the invention.

I claim:

1. A book having a spine and at least one illustration, comprising:

an electric power source in said book;

a light bulb in said book;

means to direct power from said power source to said light bulb;

means to turn said power source on and off;

at least one base sheet;

at least one cover sheet having a plane, said cover sheet disposed on said base sheet with said illustration placed on said cover sheet;

at least one aperture defined in said cover sheet corresponding to a portion of said illustration to be illuminated; and at least one fiber optic strand having a first end and a second end, said first end being aligned above said light bulb, said fiber optic strand extending between said base sheet and said cover sheet and attached therebetween, said second end of said fiber optic strand being positioned beneath said aperture, said book when said power source is in its on mode, causing said second end of said fiber optic strand to emit light through said aperture illuminating a portion of said face sheet in relation to said illustration thereon.

2. The book of claim 1 wherein said second end of said fiber optic strand is cut at an angle to form an angular planar surface at said second end of said fiber optic strand, said angular planar surface positioned parallel to the plane of said cover sheet with said angular planar surface positioned to be facing through said aperture formed in said cover sheet.

3. The book of claim 2 further including a movable color wheel disposed between said light source and said first end of said fiber optic strand.

* * * * *